US005518441A

United States Patent [19]

Valentini

[11] Patent Number: 5,518,441

[45] Date of Patent: May 21, 1996

[54] DEVICE FOR MANUAL ASSEMBLY AND REMOVAL OF WORKING DISCS IN MANUAL TOOLS FOR MACHINING SURFACES

[76] Inventor: Guido Valentini, Via Giambellino 121/A, 20146 Milan, Italy

[21] Appl. No.: 282,572

[22] Filed: Jul. 29, 1994

[30] Foreign Application Priority Data

Jul. 30, 1993 [IT] Italy ..... MI93A1724

[51] Int. Cl.[6] ..... B24B 23/00; B24B 27/08

[52] U.S. Cl. ..... 451/357; 451/344; 451/342

[58] Field of Search ..... 451/357, 344, 451/269, 342, 358, 359, 214, 215, 216, 217

[56] References Cited

U.S. PATENT DOCUMENTS

| | | | |
|---|---|---|---|
| 3,747,280 | 7/1973 | Stroezel et al. | 451/357 |
| 4,400,995 | 8/1983 | Palm | 74/527 |
| 4,610,111 | 9/1986 | Cox | 451/357 |
| 4,731,955 | 3/1988 | Henle | 451/342 |
| 4,976,071 | 12/1990 | Stabler | 451/342 |
| 5,161,334 | 11/1992 | Schaal et al. | 451/342 |
| 5,175,963 | 1/1993 | Schafer et al. | 451/342 |
| 5,261,190 | 11/1993 | Berger et al. | 451/357 |

FOREIGN PATENT DOCUMENTS

| | | | |
|---|---|---|---|
| 88004975 | 7/1988 | WIPO | 451/342 |

*Primary Examiner*—Bruce M. Kisliuk
*Assistant Examiner*—Derris Banks
*Attorney, Agent, or Firm*—Sixbey, Friedman, Leedom & Ferguson; Gerald J. Ferguson, Jr.; Tim L. Brackett, Jr.

[57] ABSTRACT

A device is described for manual assembly and removal of a working disc in a manual tool for machining surfaces. The tool comprises a hub on which the working disc is screw-fastened and that is rotatably held eccentrically by a support casing made to rotate on its own axis by a driving shaft. The device comprises a pushbutton that can be accessed from the outside and that can slide between an at rest position and a position where it engages one of its ends with a mechanical element integral with said hub to prevent the rotation of the hub while the working disc is screwed or unscrewed.

3 Claims, 2 Drawing Sheets

DEVICE FOR MANUAL ASSEMBLY AND REMOVAL OF WORKING DISCS IN MANUAL TOOLS FOR MACHINING SURFACES

TECHNICAL FIELD

The present invention relates to a device for manual assembly and removal of working discs in manual tools for machining surfaces, such as lapping machines, grinding machines and such like.

BACKGROUND OF THE INVENTION

Lapping machines and other manual tools for machining surfaces are commercially available that use a working disc screw-fastened to a hub eccentrically and rotatably held by a support casing made to rotate on its own axis by a suitably-operated driving shaft.

In these tools the problems arises of assemblying or removing the working disc when its replacement is necessary. Such operations require that the rotation of the rotating hub be stopped while the disk is screwed or unscrewed.

The greatest difficulties do not arise so much in the screwing or unscrewing operation of the working disc, that can often be done by hand, but in preventing the rotation of the hub, that generally requires the use of a spanner or other tool, with the consequent design of the tool casing with holes, operating spaces and so on.

Problems are even more evident in those tools equipped with a dust collection system, where suitable shrouds are provided that make for difficult access to the rotating hub from the outside.

One known solution that allows the rotation of the hub to be stopped without any direct action on the hub provides for the hub to have two diametrically-opposed flat milled portions on the external surface of the hub, and for the working disc to have an upper tubular end with a diameter such that it can be engaged on the hub, which end is also provided with two diametrically-opposed sections with a flat surface; when the disc is engaged on the hub, the two pairs of flat surfaces prevent relative motion between disc and hub, so that, if the disc is held with one hand, the rotation of the hub is prevented, and it becomes possible to screw up the working disc on the hub with an Allen screw inserted in a through hole in the centre of the disc.

However, the solution described has the drawback that it requires an Allen screw, not always immediately available, and there is also the risk that the Allen screw is lost.

SUMMARY OF THE INVENTION

In view of the state of the art now described, the object of the present invention is to provide a device that allows the completely manual assembly and removal of the working disc, without having to use spanners or other tools.

According to the present invention, such object is attained thanks to a device for manual assembly and removal of a working disc in a manual tool for machining surfaces, which tool comprises a hub to which the working disc is screw-fastened and that is held eccentrically and rotatably by a support casing made to rotate on its own axis by a driving shaft, characterized in that it comprises a pushbutton that can be accessed from the outside and moved between an at rest position and a position where it engages one of its ends with a mechanical element integral with said hub to prevent the rotation of the hub while the working disc is screwed or unscrewed.

Thanks to the device according to the invention it is possible to assemble or to remove the working disc in a completely manual manner, without any help from other tools.

These and other features of the present invention will be made more evident by the following detailed description of an embodiment thereof.

DESCRIPTION OF THE PREFERRED EMBODIMENT

Figure 1:
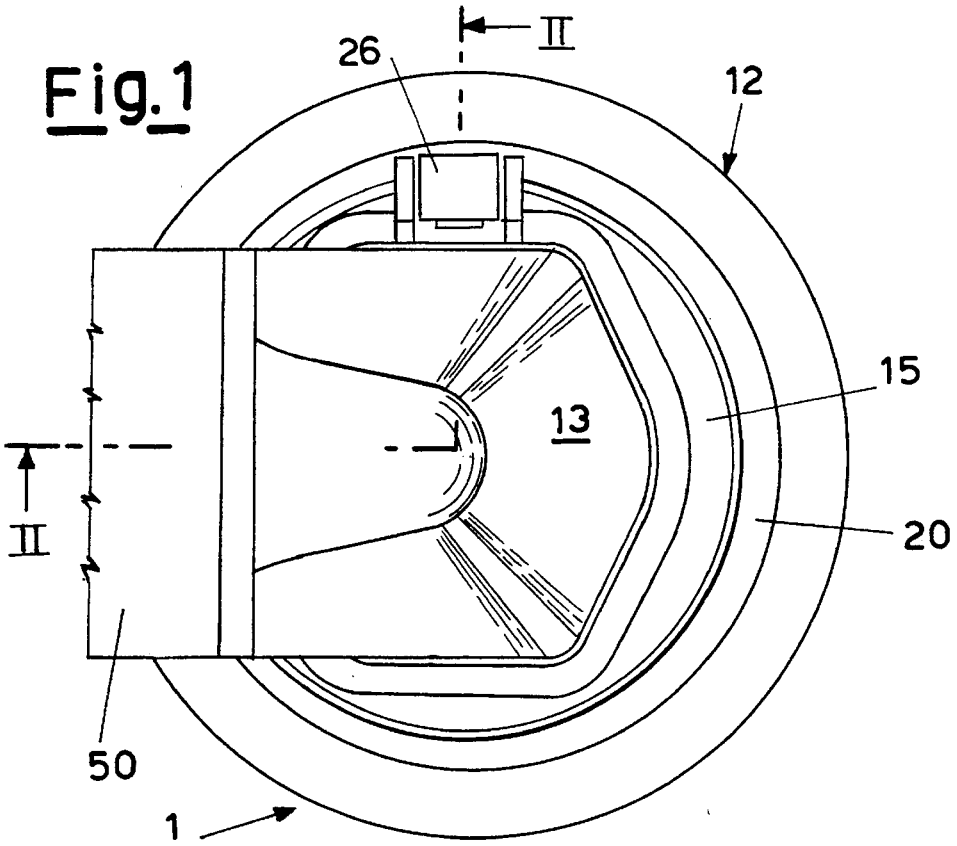
FIG. 1 shows a plan view from above of the head part of a lapping machine provided with a device according to the present invention.

A lapping machine of the type illustrated as an example in the drawings generally comprises a handle 50, in which an electric motor is enclosed, and a machining head 1 perpendicular to said handle.

Figure 2:
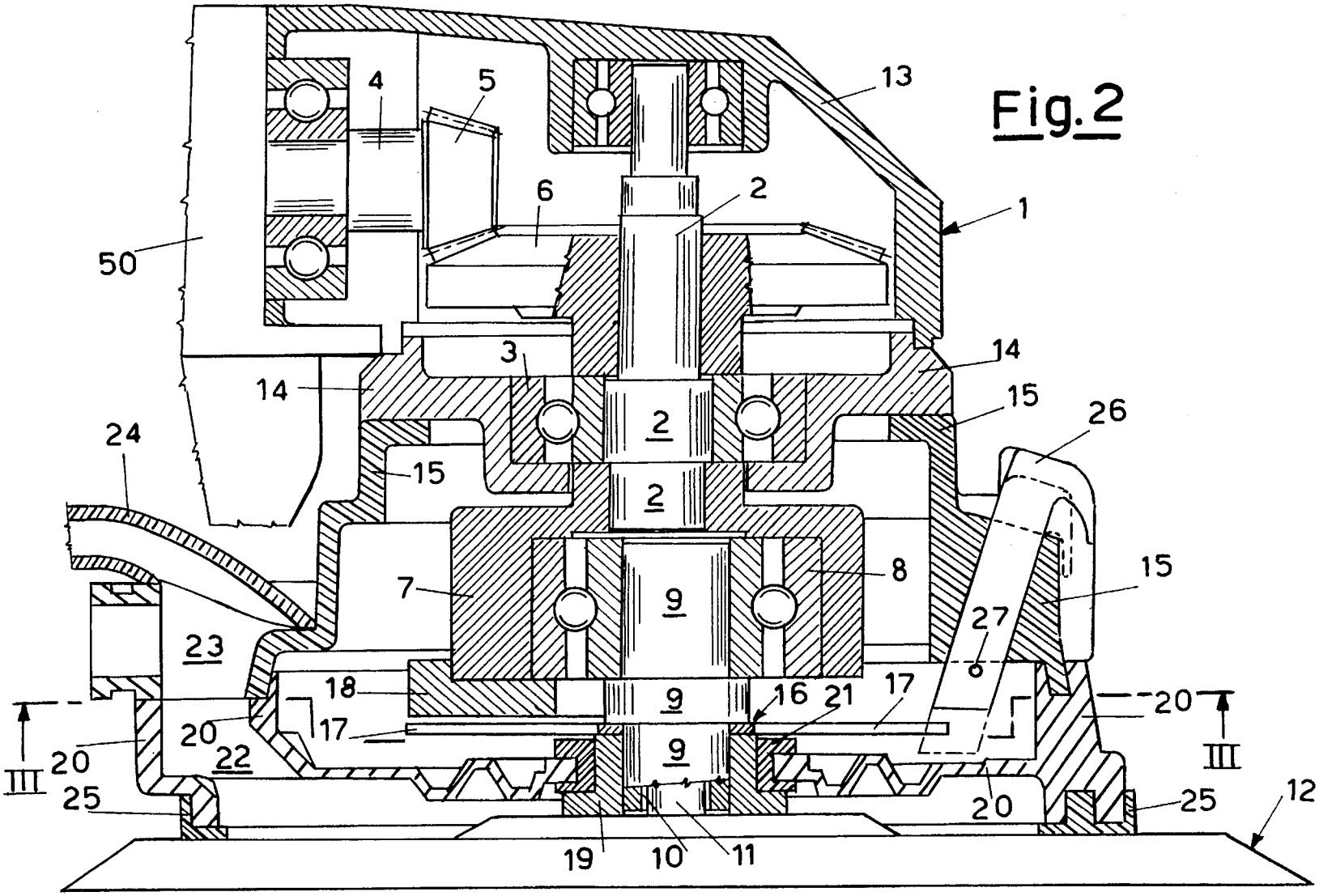
FIG. 2 is a cross-sectional view of said lapping machine head taken along the line III—III of FIG. 1.

As shown in FIG. 2, the machining head 1 is constituted by a rigid shell comprising several parts integral with one another, specifically a chassis end 13 and a flange 14 fastened to said chassis end 13, both made of metal, and a cover 15 made of plastic material.

Inside the machining head 1 a driving shaft 2, rotatably supported by a bearing 3 housed in the flange 14, receives motion from a rotor shaft 4 of the motor by means of a conical gear pair formed by gears 5 and 6 placed inside the chassis ends 13.

On the lower end of the driving shaft 2 there is fastened integrally a rotating body 7 that rotatably holds a hub 9 in an eccentric position by means of a bearing 8. To the rotating body 7 there is also fastened, in an opposite eccentric position to that of the hub 9, a counterweight 18. The lower end of the hub 9 is provided with a threaded axial hole 10, in which a threaded tang 11 is screwed up that extends from a working disc 12 destined for supporting abrasive materials (abrasive paper or such like).

Figure 3:
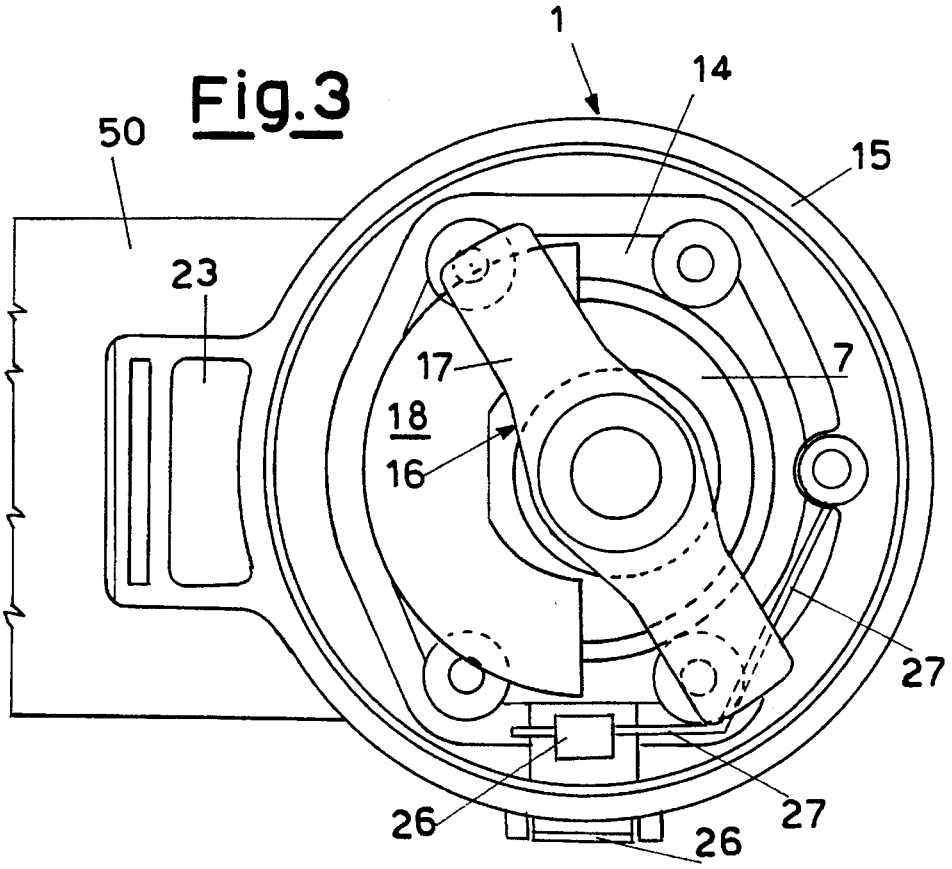
FIG. 3 is a cross-sectional view of said lapping machine head taken along the line III—III of FIG. 2.

On the lower end of the hub a metal plate 16 provided with a pair of radial vanes 17 (FIG. 3) is also fitted integrally with the hub 9*a*. A ring 19, also integral with the lower end of the hub 9, contributes to keep the plate 16 in position.

Under the cover 15 there is a rubber shroud 20 having the object of preventing the dust produced during the lapping of a surface from penetrating the area of the bearing 8. The shroud 20 is provided with a central hole in which the lower end of the hub 9 is made to pass sealingly; the internal edge of said central hole is inserted in a circular groove of an antifriction ring 21 inserted on the ring 19. The shroud 20 is also provided with a fitting 22 communicating with an upper fitting 23 obtained in the cover 15, to which one end of a dust collection conduit 24 is applied. On the lower edge of the shroud 20 a friction ring 25 is applied suitable for preventing, by friction, the rotation of the working disc 12 on its own axis, allowing only an eccentric orbital motion imparted to the disc 12 by the rotation of the rotating body 7. The presence of the counterweight 18 dampens the vibrations of the lapping machine during its operation, as caused by the eccentricity of the motion of the disc 12.

In the cover 15 there is a sliding pushbutton 26 accessible from the outside of the machining head 1 that, by virtue of a spring 27, is normally in the at rest position shown by a continuous line in FIG. 2; in this position the pushbutton does not interfere with the motion of any rotating member. But, when the pushbutton is pressed, it goes to the position illustrated by dashed and dotted lines in FIG. 2; in this position, the lower end of the pushbutton 26, interfering with one of the vanes 17, prevents the rotation of the hub 9.

During the steps of assembly and removal of the disc 12, the pushbutton 26 is pressed with one hand to prevent the rotation of the hub 9; the disc 12 can therefore be screwed or unscrewed manually with the other hand, with no need for spanners or other tools. The pushbutton is then released, and thanks to the spring 27 it returns to the position at rest. At this point the lapping machine can be activated or the subsequent assembly of the disc can be carried out.

I claim:

1. A power operated manual tool for machining surfaces, comprising a working disc screwed onto a hub which is rotatably eccentrically held by a support body caused to rotate about its own axis by a power operated driving shaft, an external casing for said hub, said support body and said driving shaft, and hub locking means comprising a plate rigidly mounted on said hub and provided with at least one radial arm extending in a plane substantially parallel to the working disc, and a pushbutton which is mounted on a lateral extension of said casing so as to be manually operable from outside to move from a rest position to a working position in which said pushbutton engages said radial arm to prevent the rotation of said hub while the working disc is being screwed and unscrewed with respect to the hub for assembling and disassembling purposes.

2. The power operated manual tool of claim 1, wherein elastic means are provided to urge said pushbutton towards said rest position.

3. The power operated manual tool of claim 1, wherein said pushbutton is slidingly mounted on said lateral extension of the casing and is movable in a direction transversal to the plane of said radial arm.

* * * * *